US010272477B2

(12) United States Patent
Zhou et al.

(10) Patent No.: US 10,272,477 B2
(45) Date of Patent: Apr. 30, 2019

(54) INTELLIGENT HUB CLEANING DEVICE

(71) Applicant: CITIC Dicastal CO., LTD., Qinhuangdao, Hebei (CN)

(72) Inventors: Ruixiao Zhou, Qinhuangdao (CN); Zhiyuan Yu, Qinhuangdao (CN); Minghua Liu, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 0 days.

(21) Appl. No.: 15/797,406

(22) Filed: Oct. 30, 2017

(65) Prior Publication Data

US 2019/0060961 A1 Feb. 28, 2019

(30) Foreign Application Priority Data

Aug. 28, 2017 (CN) ..... 2017 1 0752758

(51) Int. Cl.
*B08B 3/02* (2006.01)
*B08B 13/00* (2006.01)

(52) U.S. Cl.
CPC ..... *B08B 3/02* (2013.01); *B08B 13/00* (2013.01)

(58) Field of Classification Search
CPC .. B60S 3/042; B60S 3/04; B60S 3/041; B60S 1/68; B08B 3/02; B08B 13/00; B08B 3/024; B08B 3/022; B05B 12/30; B05B 3/0463; B05B 13/0431
USPC ..... 134/123, 45, 57 R, 172, 56 R, 18, 198, 134/58 R, 32; 15/53.4, DIG. 2, 97.3, 15/53.1, 53.3, 268; 74/490.01
See application file for complete search history.

(56) References Cited

U.S. PATENT DOCUMENTS 2,692,214 A * 10/1954 Hurst ..... B60S 3/042 134/123
2,712,320 A * 7/1955 Schroeder ..... B60S 3/042 134/123
2,716,767 A * 9/1955 Davis ..... B60S 3/042 134/123
2,716,772 A * 9/1955 Cockrell ..... B60S 3/042 134/178
2,718,650 A * 9/1955 Haverberg ..... B60S 3/042 134/123
2,761,170 A * 9/1956 Bonneau ..... B60S 3/042 134/172
2,807,271 A * 9/1957 Spinner, Jr. ..... B60S 3/042 104/172.3
2,822,564 A * 2/1958 Crivelli ..... B60S 3/042 134/45

(Continued)

*Primary Examiner* — David G Cormier
*Assistant Examiner* — Thomas Bucci
(74) *Attorney, Agent, or Firm* — Cooper Legal Group, LLC

(57) ABSTRACT

Disclosed is a hub cleaning device, including a base (1), a mounting transition plate (2), a water spraying module (3), hub conveying modules (4) and a work fixture (5), in which the water spraying module (3) is connected onto the mounting transition plate (2), and the mounting transition plate (2) is fixed on the base (1); the work fixture (5) is arranged at a position parallel to the base (1), so that the water spraying module (3) can face the front side of a hub (6); and the hub conveying modules (4) are arranged on two sides of the work fixture (5). The device is simple in structure, and eliminates cleaning dead angles. One device can complete cleaning of multiple types of hubs, thereby greatly reducing the input of enterprises on cleaning devices.

2 Claims, 3 Drawing Sheets

(56) References Cited

U.S. PATENT DOCUMENTS 2,857,605 A * 10/1958 Weishaar ..... B60S 3/042 134/153
2,910,202 A * 10/1959 Clarke ..... B60S 3/042 134/45
2,957,195 A * 10/1960 Almond ..... B60S 3/042 134/123
2,975,446 A * 3/1961 Furman ..... B60S 3/042 15/53.4
2,978,718 A * 4/1961 Vani ..... B60S 3/042 15/53.4
3,043,317 A * 7/1962 Hursen ..... C21D 1/667 134/102.1
3,208,089 A * 9/1965 Vani ..... B60S 3/042 15/53.4
3,305,886 A * 2/1967 Fricke ..... B60S 3/042 15/53.4
3,391,700 A * 7/1968 Lawter ..... B60S 3/004 134/45
3,446,217 A * 5/1969 Collier ..... B60S 3/042 134/172
3,448,717 A * 6/1969 Kuhlman ..... B05B 13/0405 118/315
3,596,241 A * 7/1971 Migneault ..... B60S 3/00 134/45
3,628,212 A * 12/1971 Van Brakel ..... B60S 3/042 15/53.4
3,643,272 A * 2/1972 Rickel ..... B60S 3/042 15/53.4
3,643,275 A * 2/1972 Van Brakel ..... B60S 3/042 15/53.4
3,662,417 A * 5/1972 Fuhring ..... B60S 3/042 15/53.4
3,674,211 A * 7/1972 Gage ..... A22B 5/08 134/123
3,681,805 A * 8/1972 Shelstad ..... B60S 3/004 104/172.3
3,822,431 A * 7/1974 Van Brakel ..... B60S 3/06 15/53.4
3,903,559 A * 9/1975 Kuster ..... B60S 3/042 15/53.4
3,913,162 A * 10/1975 Parkin ..... B60S 3/042 15/53.4
4,023,228 A * 5/1977 Hanna ..... B60S 3/042 15/53.4
4,178,948 A * 12/1979 Swinehart ..... B60S 3/042 134/45
4,192,037 A * 3/1980 Capra ..... B60S 3/042 15/53.4
4,269,141 A * 5/1981 Kennett ..... B60S 3/042 118/313
4,308,631 A * 1/1982 Hanna ..... B60S 3/042 15/53.4
4,424,823 A * 1/1984 Gougoulas ..... B60S 3/042 134/100.1
4,550,464 A * 11/1985 Messing ..... B60S 3/042 15/53.4
4,651,925 A * 3/1987 Harris ..... B05B 3/0413 134/123
4,694,523 A * 9/1987 Van Brakel ..... B60S 3/042 15/53.4
4,718,439 A * 1/1988 Gorra ..... B60S 3/04 118/323
4,719,932 A * 1/1988 Burton ..... B60S 3/04 134/123
4,726,388 A * 2/1988 Swinehart ..... B60S 3/04 134/123
4,809,721 A * 3/1989 Messing ..... B60S 3/002 134/123
4,830,033 A * 5/1989 Hanna ..... B60S 3/042 134/123
4,870,921 A * 10/1989 Svensson ..... B05B 15/62 118/676
4,878,262 A * 11/1989 Stufflebeam ..... B60S 3/042 15/53.4
4,916,771 A * 4/1990 Weigele ..... B60S 3/042 15/53.4
4,937,759 A * 6/1990 Vold ..... B25J 9/1602 700/262
4,946,513 A * 8/1990 Del Prato ..... B60S 3/04 134/113
4,971,084 A * 11/1990 Smith ..... B60S 3/042 134/123
4,977,689 A * 12/1990 Belanger ..... B60S 3/04 15/307
4,979,536 A * 12/1990 Midkiff ..... B60S 3/042 134/123
4,981,523 A * 1/1991 Larson ..... B60S 3/04 134/172
4,985,957 A * 1/1991 Belanger ..... B60S 3/042 134/123
5,052,629 A * 10/1991 Belanger ..... B60S 3/042 134/123
5,098,744 A * 3/1992 Enegren ..... B08B 3/022 134/123
5,110,049 A * 5/1992 Harris ..... B60S 3/044 134/123
5,123,136 A * 6/1992 Belanger ..... B60S 3/042 134/134
5,125,981 A * 6/1992 Belanger ..... B60S 3/042 134/123
5,161,557 A * 11/1992 Scheiter, Jr. ..... B60S 3/04 134/123
5,226,436 A * 7/1993 Kirby ..... B60S 3/04 134/123
5,226,971 A * 7/1993 Fogal ..... B08B 3/04 134/123
5,291,696 A * 3/1994 Enegren ..... B08B 3/022 451/83
5,291,906 A * 3/1994 White ..... B60S 3/04 134/123
5,309,931 A * 5/1994 Meyer, III ..... B60S 3/042 134/123
5,432,974 A * 7/1995 Yasutake ..... B60S 3/002 134/123
5,447,574 A * 9/1995 Inoue ..... B08B 3/024 134/123
5,778,908 A * 7/1998 Shelstad ..... B60S 3/042 134/123
5,853,127 A * 12/1998 Heembrock ..... B08B 3/02 239/227
5,911,259 A * 6/1999 Baldi ..... B08B 5/02 15/303
6,082,634 A * 7/2000 MacNeil ..... B05B 3/02 134/123
6,270,586 B1 * 8/2001 Soble ..... B60S 3/042 134/123
6,383,295 B1 * 5/2002 Frederick, Jr. ..... B60S 3/042 118/680
6,461,685 B2 * 10/2002 Gorra ..... B60S 3/004 118/264
6,519,860 B1 * 2/2003 Bieg ..... B23H 7/26 33/1 PT
6,540,470 B2 * 4/2003 Smith ..... B60S 3/041 134/123
6,668,466 B1 * 12/2003 Bieg ..... G01B 5/008 33/1 PT
7,234,186 B2 * 6/2007 Peters ..... A46B 13/001 15/21.1
7,243,665 B1 * 7/2007 Turner ..... B60S 3/042 134/100.1
7,582,164 B1 * 9/2009 Krause ..... B24B 5/366 118/321
8,397,661 B2 * 3/2013 Belanger ..... B08B 1/02 118/256
8,424,480 B2 * 4/2013 Wentworth ..... B60S 3/042 118/244
8,769,756 B2 * 7/2014 Wentworth ..... B60S 3/042 118/244

(56) References Cited

U.S. PATENT DOCUMENTS

2002/0004961 A1* 1/2002 Nishina ..... A61G 5/10 15/53.4
2002/0117193 A1* 8/2002 Anderson ..... B60S 3/04 134/113
2004/0020519 A1* 2/2004 Taylor ..... B60S 3/042 134/36
2004/0065349 A1* 4/2004 Scheiter, Jr. ..... B60S 3/04 134/18
2004/0221878 A1* 11/2004 Johnson ..... B60S 3/04 134/56 R
2005/0028846 A1* 2/2005 Fratello ..... B05B 3/0463 134/123
2005/0166413 A1* 8/2005 Crampton ..... B25J 13/088 33/503
2007/0000526 A1* 1/2007 Dieziger ..... B60S 3/042 134/123
2007/0009656 A1* 1/2007 Nagase ..... B05B 1/14 427/154
2007/0068554 A1* 3/2007 Essenburg ..... B60S 3/042 134/18
2007/0175498 A1* 8/2007 Smith ..... B60S 3/042 134/34
2007/0215185 A1* 9/2007 Broadhurst ..... B60S 3/041 134/45
2007/0227558 A1* 10/2007 Chase ..... B08B 3/024 134/18
2007/0246088 A1* 10/2007 Rennie ..... B60S 3/04 134/123
2007/0289616 A1* 12/2007 McCadden ..... B05B 3/0463 134/123
2008/0000508 A1* 1/2008 Lee ..... B60S 3/004 134/123
2008/0029135 A1* 2/2008 McCadden ..... B05B 3/0463 134/123
2008/0093322 A1* 4/2008 Ehrenleitner ..... B25J 17/0266 212/274
2008/0178402 A1* 7/2008 Martines ..... B60S 3/042 15/53.2
2008/0185019 A1* 8/2008 Hodge ..... B08B 3/024 134/18
2008/0229531 A1* 9/2008 Takida ..... B60S 3/042 15/53.2
2009/0025159 A1* 1/2009 Rau ..... B08B 1/04 15/53.4
2009/0145255 A1* 6/2009 Ehrenleitner ..... B25J 9/106 74/490.01
2009/0217955 A1* 9/2009 Harrell ..... B08B 3/02 134/56 R
2009/0250084 A1* 10/2009 Belanger ..... B60S 3/042 134/123
2009/0272409 A1* 11/2009 Petit ..... B60S 3/002 134/32
2010/0256812 A1* 10/2010 Tsusaka ..... A47L 9/24 700/254
2010/0281638 A1* 11/2010 Reed ..... B60S 3/042 15/53.4
2010/0307531 A1* 12/2010 Aharonov ..... B60S 3/041 134/6
2011/0035889 A1* 2/2011 Keusch ..... B60S 3/042 15/53.4
2011/0078865 A1* 4/2011 Pecora ..... B60S 3/042 15/53.4
2011/0115650 A1* 5/2011 Wimmer ..... B60S 3/004 340/989
2011/0170534 A1* 7/2011 York ..... H04J 3/0667 370/350
2012/0171383 A1* 7/2012 Christensen ..... B05B 13/0426 427/427.3
2013/0186432 A1* 7/2013 Wimmer ..... B60S 3/042 134/6
2013/0291906 A1* 11/2013 Belanger ..... B60S 3/042 134/123
2013/0291909 A1* 11/2013 Belanger ..... B60S 3/04 134/56 R
2013/0333127 A1* 12/2013 Langer ..... B60S 3/042 15/53.4
2014/0170324 A1* 6/2014 Kohonen ..... B05B 12/30 427/372.2
2015/0151314 A1* 6/2015 Hendricks, Sr. ..... B05B 9/042 118/300
2016/0159326 A1* 6/2016 Klemedtson ..... B60S 3/042 134/123
2016/0250749 A1* 9/2016 Gan ..... B29C 7/386 74/490.05
2016/0271803 A1* 9/2016 Stewart ..... B25J 11/0085
2016/0313114 A1* 10/2016 Tohme ..... H04N 13/239

* cited by examiner

INTELLIGENT HUB CLEANING DEVICE

CROSS-REFERENCE TO RELATED APPLICATIONS

This application is filed based upon and claims priority to Chinese Patent Application No. 201710752758.4, filed on Aug. 28, 2017, the entire contents of which are incorporated herein by reference.

BACKGROUND

The cleaning procedure is an important procedure in the production process of an aluminum alloy hub. The existing hub cleaning methods roughly can be divided into manual, brush and high pressure nozzle ones. The manual cleaning method is low in degree of automation, low in efficiency and severe in working environment, and is thus not suitable for large batch production. In the process of cleaning a hub by a brush-type cleaning machine, the cleaning of the hub is not simple plane cleaning, the central height of the hub of each vehicle type is different, and the placing angles and positions when wheels are cleaned are slightly different, so cleaning dead angles exist in the conventional cleaning process and are difficult to clean, and harmful effects are produced on follow-up coating. The brush cleaning method cannot realize automatic centering and then cannot effectively clean a hub, and it cannot adapt to cleaning hubs of different vehicle types. Although the high pressure nozzle method can be used for cleaning hubs in various shapes, the cleaning area of a single nozzle is small, and a plurality of nozzles are needed to improve the cleaning efficiency, resulting in increase of the cost. Therefore, a device which can adapt to cleaning of different types of hubs and is relatively low in cost in the disclosure has very positive practical significance.

SUMMARY

The disclosure relates to the technical fields of aluminum alloy casting and machining, and specifically relates to a hub cleaning device.

The disclosure is aimed at providing a hub cleaning device, thus overcoming the defects that the traditional hub cleaning methods cannot realize cleaning of multiple types of hubs, have cleaning dead angles, are relatively high in cost and the like.

A hub cleaning device includes a base, a mounting transition plate, a water spraying module, hub conveying modules and a work fixture.

The water spraying module is connected onto the mounting transition plate by bolt connection, and the mounting transition plate is fixed on the base by bolt connection. The work fixture is arranged at a position parallel to the base, so that the water spraying module can face the front side of a hub. The hub conveying modules are arranged on two sides of the work fixture.

The water spraying module includes a fixed platform, hooke joints, drive rods, sliding rods, ball joints, displacement sensors, high pressure nozzles, a movable platform and water pipes. The water spraying module is characterized in that the fixed platform is connected onto the mounting transition plate by bolt connection. The hooke joints are connected onto the fixed platform by bolt connection. The drive rod is fixed on the shaft of the hooke joint. One end of the sliding rod and the drive rod form a sliding pair, and the other end of the sliding rod is fixedly connected with the ball joint. The ball joints are connected with the movable platform by bolt connection. The high pressure nozzles and the displacement sensors are arranged on the movable platform. The displacement sensors are arranged nearby the high pressure nozzles. The water pipes communicate with the high pressure nozzles to provide high pressure water for the high pressure nozzles.

The hooke joint, the drive rod, the sliding rod and the ball joint form a supporting leg. A plurality of such supporting legs, the fixed platform and the movable platform form a parallel adjustable platform, and relative to a series adjustable platform, the parallel adjustable platform is higher in rigidity, higher in precision and more flexible in motion. Generally, the quantity of the supporting legs is three to six. In an embodiment, three supporting legs may be used in the disclosure to form a UPS six degree of freedom parallel platform, thus reducing the cost.

The work fixture includes a support frame, V-shaped blocks, a baffle, a pressure block, a threaded rod, a water fender and a handle. The work fixture is characterized in that the V-shaped blocks are arranged on the support frame and in two columns, and are used for center positioning on rims of two sides of the hub. The baffle is arranged on one side of the V-shaped blocks, and the pressure block is arranged on the other side of the V-shaped blocks and used for fixing the hub. The pressure block is adjusted via the handle, the threaded rod is fixed with the pressure block and the handle and connected with a threaded hole in the support frame by threaded connection, and thus, the pressure block can be adjusted by rotating the handle to clamp hubs of different types.

When the hub of a different type is conveyed to the work fixture by the hub conveying modules, the hub is positioned by the V-shaped blocks, and then the pressure block clamps the hub by tightening the handle. At the moment, the positions of the high pressure nozzles can be adjusted in real time via the water spraying module, so that they can adapt to different types of hubs. The displacement sensors arranged on the movable platform can feed back the distance between the high pressure nozzles and the surface of the opposite object in real time. When the distance value is within a given range, the front sides of the high pressure nozzles face the surface of the hub, and the surface needs to be cleaned. When the distance value is beyond the given range, the front sides of the high pressure nozzles do not face the surface of the hub, cleaning is not needed, and then the position and posture of the movable platform are adjusted by controlling the extensions of the drive rods, till the high pressure nozzles face the surface of the hub. Thus, a closed loop control is formed, and the surface that needs to be cleaned can be automatically sought. In addition, the adjusting range of the water spraying module is set according to the maximum size of different types of hubs to be cleaned, and thus, one hub cleaning device can realize the function of cleaning different types of hubs.

The disclosure is simple in structure and convenient to operate, and eliminates cleaning dead angles. One device can complete cleaning of multiple types of hubs, thereby greatly reducing the input of enterprises on cleaning devices and saving a lot of money for the enterprises. In addition, the disclosure is high in degree of intelligence, and can automatically seek the hub surface that needs to be cleaned, thereby avoiding time and cleaner waste on the surface that does not need to be cleaned, further improving the production efficiency and reducing the cost.

BRIEF DESCRIPTION OF THE DRAWINGS

The implementation scheme of the disclosure will be described in detail below in combination with the accompanying drawings.

Figure 1:
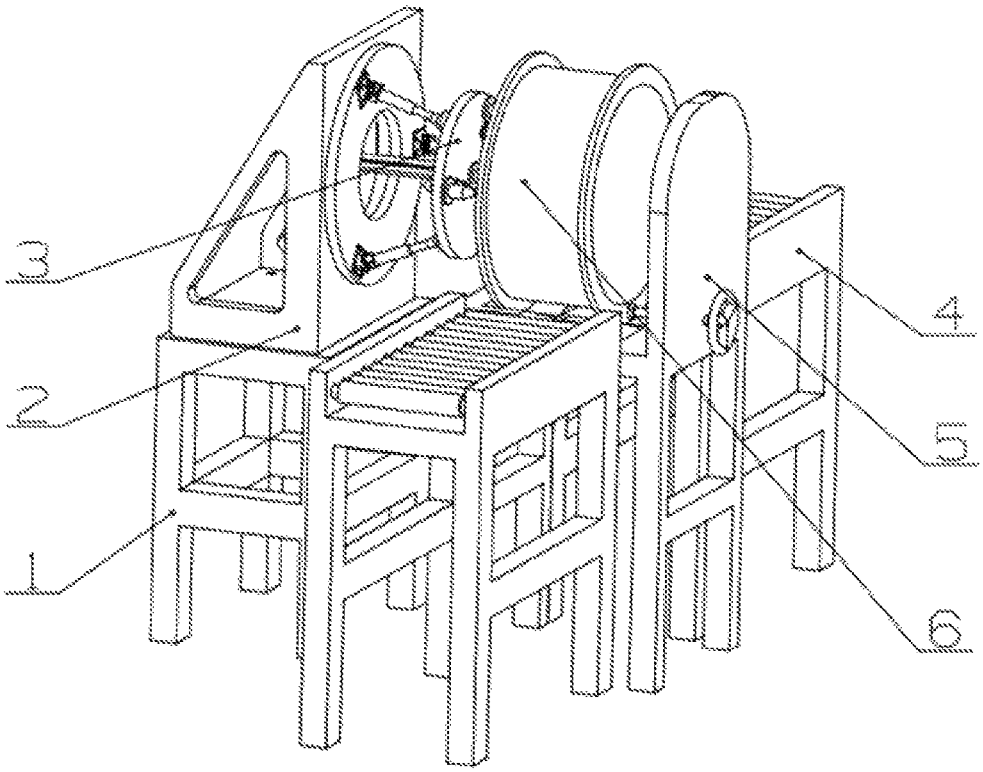
FIG. 1 is a structural schematic diagram of a hub cleaning device.
Figure 2:
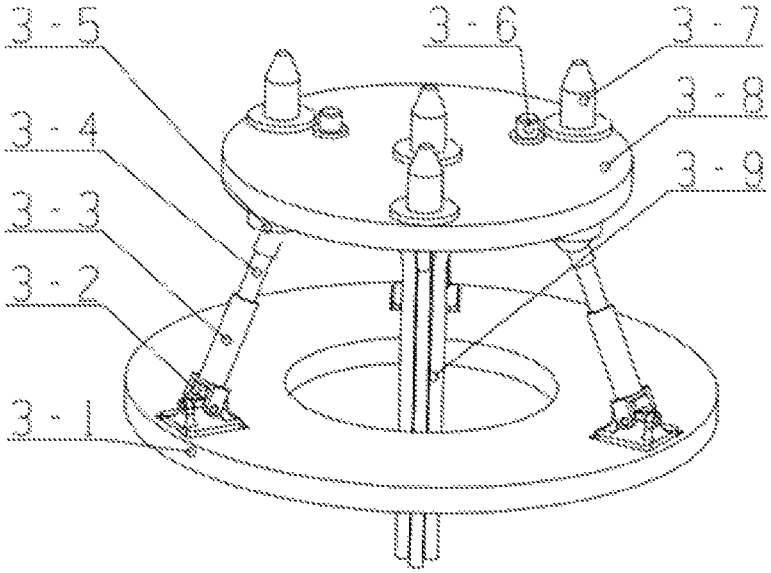
FIG. 2 is a structural schematic diagram of a water spraying module of the disclosure.
Figure 3:
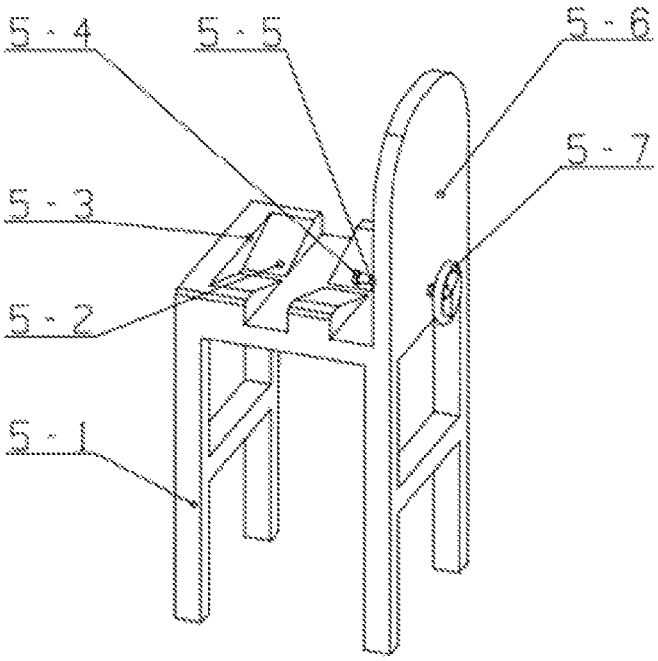
FIG. 3 is a structural schematic diagram of a work fixture of the disclosure.

In which, 1—base, 2—mounting transition plate, 3—water spraying module, 4—hub conveying module, 5—work fixture, 6—hub, 3-1—fixed platform, 3-2—hooke joint, 3-3—drive rod, 3-4—sliding rod, 3-5—ball joint, 3-6—displacement sensor, 3-7—high pressure nozzle, 3-8—movable platform, 3-9—water pipe, 5-1—support frame, 5-2—V-shaped block, 5-3—baffle, 5-4—pressure block, 5-5—threaded rod, 5-6—water fender, 5-7—handle.

DETAILED DESCRIPTION

Embodiment 1

This embodiment discloses a hub cleaning device. The device includes a base 1, a mounting transition plate 2, a water spraying module 3, hub conveying modules 4 and a work fixture 5.

The water spraying module 3 is connected onto the mounting transition plate 2 by bolt connection, and the mounting transition plate 2 is fixed on the base 1 by bolt connection. The work fixture 5 is arranged at a position parallel to the base 1, so that the water spraying module 3 can face the front side of a hub 6. The hub conveying modules 4 are arranged on two sides of the work fixture 5.

The water spraying module 3 includes a fixed platform 3-1, hooke joints 3-2, drive rods 3-3, sliding rods 3-4, ball joints 3-5, displacement sensors 3-6, high pressure nozzles 3-7, a movable platform 3-8 and water pipes 3-9. The water spraying module 3 is characterized in that the fixed platform 3-1 is connected onto the mounting transition plate 2 by bolt connection. The hooke joints 3-2 are connected onto the fixed platform 3-1 by bolt connection. The drive rod 3-3 is fixed on the shaft of the hooke joint 3-2. One end of the sliding rod 3-4 and the drive rod 3-3 form a sliding pair, and the other end of the sliding rod 3-4 is fixedly connected with the ball joint 3-5. The ball joints 3-5 are connected with the movable platform 3-8 by bolt connection. The high pressure nozzles 3-7 and the displacement sensors 3-6 are arranged on the movable platform 3-8. The displacement sensors 3-6 are arranged nearby the high pressure nozzles 3-7. The water pipes 3-9 communicate with the high pressure nozzles 3-7 to provide high pressure water for the high pressure nozzles 3-7.

The hooke joint 3-2, the drive rod 3-3, the sliding rod 3-4 and the ball joint 3-5 form a supporting leg. A plurality of such supporting legs, the fixed platform 3-1 and the movable platform 3-8 form a parallel adjustable platform, and relative to a series adjustable platform, the parallel adjustable platform is higher in rigidity, higher in precision and more flexible in motion. Generally, the quantity of the supporting legs is three to six. In an embodiment, three supporting legs may be used in the disclosure to form a 3-UPS six-degree-of-freedom parallel platform, thus reducing the cost.

The work fixture 5 includes a support frame 5-1, V-shaped blocks 5-2, a baffle 5-3, a pressure block 5-4, a threaded rod 5-5, a water fender 5-6 and a handle 5-7. The work fixture 5 is characterized in that the V-shaped blocks 5-2 are arranged on the support frame 5-1 and in two columns, and are used for center positioning on rims of two sides of the hub 6. The baffle 5-3 is arranged on one side of the V-shaped blocks 5-2, and the pressure block 5-4 is arranged on the other side of the V-shaped blocks 5-2 and used for fixing the hub 6. The pressure block 5-4 is adjusted via the handle 5-7, the threaded rod 5-5 is fixed with the pressure block 5-4 and the handle 5-7 and connected with a threaded hole in the support frame 5-1 by threaded connection, thus, the pressure block 5-4 can be adjusted by rotating the handle 5-7 to clamp hubs 6 of different types.

When the hub 6 of a different type is conveyed to the work fixture 5 by the hub conveying modules 4, the hub 6 is positioned by the V-shaped blocks 5-2, and then the pressure block 5-4 clamps the hub 6 by tightening the handle 5-7. At the moment, the positions of the high pressure nozzles 3-7 can be adjusted in real time via the water spraying module 3, so that they can adapt to different types of hubs 6. The displacement sensors 3-6 arranged on the movable platform 3-8 can feed back the distance between the high pressure nozzles 3-7 and the surface of the opposite object in real time. When the distance value is within a given range, the front sides of the high pressure nozzles face the surface of the hub 6, and the surface needs to be cleaned. When the distance value is beyond the given range, the front sides of the high pressure nozzles 3-7 do not face the surface of the hub 6, cleaning is not needed, and then the position and posture of the movable platform 3-8 are adjusted by controlling the extensions of the drive rods 3-3, till the high pressure nozzles 3-7 face the surface of the hub 6. Thus, a closed-loop control is formed, and the surface that needs to be cleaned can be automatically sought. In addition, the adjusting range of the water spraying module 3 is set according to the maximum size of different types of hubs 6 to be cleaned, and thus, one hub cleaning device can realize the function of cleaning different types of hubs.

Described above is merely a preferred embodiment of the disclosure. Changes may be made to the specific embodiment and the application scope for those of ordinary skill in the art according to the thought of the disclosure. The content of the specification should not be understood as limiting the disclosure.

The invention claimed is:

1. A hub cleaning device, including a base, a mounting transition plate, a water spraying module, hub conveying modules and a work fixture, wherein the water spraying module is connected onto the mounting transition plate, and the mounting transition plate is fixed on the base; the work fixture is arranged at such a position that the water spraying module can face a front side of a hub; one or more of the hub conveying modules are arranged on either side of the work fixture;

the water spraying module includes a fixed platform, hooke joints, drive rods, sliding rods, ball joints, displacement sensors, high pressure nozzles, a movable platform and water pipes; the fixed platform is connected onto the mounting transition plate; the hooke joints are connected onto the fixed platform; the drive rods are fixed on a shaft of the hooke joints; one end of the sliding rods and the drive rods form a sliding pair, and the other end of the sliding rods are fixedly connected with the ball joints; the ball joints are connected with the movable platform; the high pressure nozzles and the displacement sensors are arranged on the movable platform; the displacement sensors are arranged nearby the high pressure nozzles; each of the water pipes communicate with each of the high pressure nozzles, respectively;

the hooke joints, the drive rods, the sliding rods and the ball joints form supporting legs; the supporting legs, the fixed platform and the movable platform form a parallel adjustable platform, and a quantity of the supporting legs is three to six;

the work fixture includes a support frame, V-shaped blocks, a baffle, a pressure block, a threaded rod, a water fender and a handle; the V-shaped blocks are arranged on the support frame and in two columns, and in each of the two columns there is provided one V-shaped block; the baffle is arranged on one side of the V-shaped blocks, and the pressure block is arranged on the other side of the V-shaped blocks; the pressure block is adjusted via the handle, the threaded rod is fixed with the pressure block and the handle and connected with a threaded hole in the support frame, and thus, the pressure block can be adjusted by rotating the handle to clamp hubs of different types.

2. The hub cleaning device of claim 1, in which the quantity of the supporting legs formed by the hooke joints, the drive rods, the sliding rods and the ball joints is three, and a 3-UPS six-degree-of-freedom parallel platform is thus formed.

* * * * *